US005664967A

United States Patent [19]

Hatagishi et al.

[11] Patent Number: 5,664,967

[45] Date of Patent: Sep. 9, 1997

[54] PRESS-CONNECTING CONNECTOR

[75] Inventors: Yuji Hatagishi; Chieko Torii, both of Shizuoka, Japan

[73] Assignee: Yazaki Corporation, Tokyo, Japan

[21] Appl. No.: 527,680

[22] Filed: Sep. 13, 1995

[30] Foreign Application Priority Data

Sep. 19, 1994 [JP] Japan ..... 6-223749

[51] Int. Cl.[6] ..... H01R 13/40

[52] U.S. Cl. ..... 439/596; 439/877

[58] Field of Search ..... 439/596, 421, 439/423, 424, 877

[56] References Cited

U.S. PATENT DOCUMENTS

| | | | |
|---|---|---|---|
| 4,657,320 | 4/1987 | Bamford et al. | 439/596 |
| 4,750,893 | 6/1988 | Sueyoshi et al. | 439/596 |
| 4,790,771 | 12/1988 | Kleiner | 439/421 |

*Primary Examiner*—Neil Abrams
*Assistant Examiner*—Barry Matthew L. Standig
*Attorney, Agent, or Firm*—Sughrue, Mion, Zinn, Macpeak & Seas

[57] ABSTRACT

A connector housing has terminal receiving chambers for respectively receiving press-connecting terminals, and those portions of the partition walls disposed facing outer sides of crimp arms of the press-connecting terminals can be retracted from an initial position where those portions of the partition walls are disposed facing outer sides of the crimp, arms. During the press-connecting operation, those portions of the partition walls are retracted, and after the press-connecting operation is completed, those portions are returned to their initial position, thereby suitably isolating the press-connecting terminals from one another. Thus, even if the thickness of the partition walls is reduced, they will not be deformed during press-fitting of a wire, and the resulting inadequate deformation of crimp arms of the terminals is eliminated.

14 Claims, 7 Drawing Sheets

PRESS-CONNECTING CONNECTOR

BACKGROUND OF THE INVENTION

1. Field of the Invention

This invention relates to a press-connecting connector having press-connecting terminals and a plurality of terminal receiving chambers for receiving the press-connecting terminals in a neatly-arranged manner.

2. Background

A conventional press-connecting connector as disclosed in U.S. Pat. No. 5,252,094 will now be described with reference to FIG. 13. In this connector, a press-connecting terminal 1 includes an electrical connection portion 5 formed at its front portion for connection to a mating terminal, a press-connecting portion 6 formed at its central portion for press-connecting a wire thereto from the upper side, and a wire fixing portion 7 formed at its rear end portion for compressively holding the outer peripheral surface of the wire. This press-connecting terminal is formed into an integral construction by blanking an electrically-conductive, thin metal sheet. The electrical connection portion 5 has a female configuration having a pair of curved piece portions, and is adapted to snugly receive the mating pin-like terminal (not shown) therein. The press-connecting portion 6 has press-connecting blades 11 which cut an insulating sheath of the sheathed wire when the sheathed wire is press-fitted into these blades 11, thereby making an electrical connection between the blades 11 and a conductor of the sheathed wire. The wire fixing portion 7 includes a pair of crimp arms 13 which are deformed by a press-connecting tool (not shown) to compressively embrace the outer peripheral surface of the sheathed wire. The crimp arms 13 are thus deformed, thereby clamping the wire against withdrawal from the terminal.

A connector housing 3 includes a horizontal base plate 17, and a plurality of partition walls 16 formed upright on this base plate to form terminal receiving chambers 2 juxtaposed in a lateral direction. The press-connecting terminal 1 is received in the terminal receiving chamber 2, and is held in position by the horizontal base plate 17, the partition walls 16 and an upper outer wall 19 formed at a front portion of the housing.

The press-connecting terminal 1 is inserted into the associated terminal receiving chamber 2, with the electrical connection portion 5 directed forwardly, as indicated by arrow A in FIG. 13, and then is engaged with a retaining projection, formed on the partition wall 16 or the horizontal base plate 17, to be retained against withdrawal. In this kind of press-connecting connector, before the sheathed wire can be press-fitted into the press-connecting terminal 1, received in the terminal receiving chamber 2, from the upper side to effect a wire connection operation, that portion of the upper outer wall 19 corresponding to the press-connecting portion 6 and the wire fixing portion 7 of the press-connecting terminal 1 is removed or cut.

FIGS. 14(*a*)–(*c*) show such a wire connection operation in the conventional press-connecting connector. The sheathed wire 20 is press-fitted into the press-connecting terminal 1, received in the terminal receiving chamber 2, by a descending crimper 21 of the press-connecting tool. FIGS. 14(*a*) to 14(*c*) show a sequential press-connecting operation proceeding in accordance with the downward movement of the crimper 21. More specifically, FIG. 14(*a*) shows a stage immediately before the sheathed wire 20 is press-fitted into the press-connecting terminal 1 by the crimper 21. FIG. 14(*b*) shows a stage in which the sheathed wire 20 begins to be press-fitted into a slit 23 between the press-connecting blades 11 by the crimper 21, and at the same time the distal end portions of the crimp arms 13 are curved toward the sheathed wire 20 by a crimp formation surface 24 formed on the crimper 21, thus starting the clamping deformation of the crimp arms 13.

FIG. 14(*c*) shows a stage in which the crimper moves downward to a lower limit to complete the press-fitting operation. Thereafter, the crimper 21 moves upward, and is returned to its initial position.

In the condition shown in FIG. 14(*c*), the insulating sheath 25 of the sheathed wire, press-fitted in the slit 23 between the press-connecting blades 11, is cut by the press-connecting blades 11, so that an electrical connection between the conductor 26 and the press-connecting blades 11 is created. The crimp arms 13 at the rear end portion of the terminal are firmly clamped to the insulating sheath 25 of the sheathed wire 20 in embracing relation to the sheathed wire 20.

At this time, the crimp arms 13 are much deformed and curved by the pressing force applied from the crimper 21, thus achieving a compressive holding effect, as shown in the drawings. To facilitate this deformation and also to increase the strength of adhesion of the press-connecting terminal 1 to the housing after the completion of the deformation, each partition wall 16 has a recess or recesses 28 for curving the crimp arm 13 properly during the deformation of the crimp arm 13.

In the above conventional connector, for deforming each crimp arm 13 for clamping purposes, a reaction force from the partition wall 16 against which the crimp arm 13 is held is utilized effectively.

In the above conventional connector, however, in the case where each partition wall 16 has a reduced thickness as a result of a compact connector design, the adjacent partition walls 16 are deformed or forced outwardly away from each other as a result of abutment of the crimp arms 13 against the respective partition walls 16, thus damaging the housing, as shown in FIG. 15. Also, there is a risk that the crimper 21, acting on the adjoining terminal, will impinge on the thus deformed partition wall 16, so the clamping deformation of this terminal can not be effected.

SUMMARY OF THE INVENTION

It is an object of this invention to overcome the above problems, and more specifically to provide a press-connecting connector in which even if partition walls are reduced in thickness as a result of a compact connector design, the partition walls are prevented from becoming deformed during press-fitting of a wire, and the disadvantage of inadequate deformation of the crimp arms of a press-connecting terminal is eliminated, thereby enabling smooth and positive press-connection of the wire.

The above object has been achieved by a press-connecting connector of the invention comprising press-connecting terminals each including a press-connecting portion for press-connecting a sheathed wire thereto from an upper side, and a wire fixing portion disposed rearward of the press-connecting portion which is deformed to clamp the sheathed wire; and a connector housing having partition walls dividing the connector housing into parallel-disposed, terminal receiving chambers which receive the press-connecting terminals, respectively; wherein the terminal receiving chambers, respectively receiving the press-connecting terminals, are so constructed that those portions of the partition walls disposed facing opposite sides of the wire fixing portions can be retracted from the position where those said portions of the partition walls are disposed facing the opposite sides of the wire fixing portions.

Preferably, an upper wall rear portion is pivotally connected to the connector housing, and has side wall rear portions formed thereon generally perpendicularly thereto, wherein when the upper wall rear portion is moved into its closed position, the side wall rear portions face opposite sides of the wire fixing portions of the press-connecting terminals received in the terminal receiving chambers.

Preferably, the connector housing has a horizontal base plate having the partition walls formed thereon generally perpendicularly thereto, and openings being formed through the horizontal base plate, wherein crimp assisting walls of a tool pass respectively through the openings to respectively face the opposite sides of the wire fixing portions of the press-connecting terminals, received respectively in the terminal receiving chambers, to assist in deforming the wire fixing portions for clamping purposes.

Preferably, the connector housing includes a horizontal base plate, and that portion of the horizontal base plate corresponding to the press-connecting portions and the wire fixing portions of the press-connecting terminals can be retracted together with those portions of the partition walls disposed facing the opposite sides of the wire fixing portions.

When the sheathed wires are to be press-fitted into the respective press-connecting terminals mounted respectively in the terminal receiving chambers in the connector housing, those portions of the partition walls of the terminal receiving chambers disposed facing the outer sides of crimp arms are retracted from the position where those portions are disposed facing the outer sides of the crimp arms. By doing so, the crimp arms of the press-connecting terminal, deformed for clamping purposes during the press-fitting operation, will not interfere with the partition walls of the connector housings. As a result, even if the partition walls are reduced in thickness as a result of a compact connector design, undesirable deformation of the partition walls can be prevented.

The press-connecting tool for deforming the crimp arms of the press-connecting terminals during the press-connecting operation have crimp assisting walls which face the outer sides of the crimp arms to assist in deforming the crimping arms. By doing so, the crimp arms can be properly deformed for clamping purposes, and the disadvantage of inadequate clamping deformation of the crimp arms is eliminated.

After the crimp arms are deformed, the aforementioned portions of the partition walls are returned from their retracted position to their initial position, so that the press-connecting terminals, received in the adjacent terminal receiving chambers, are prevented from accidentally contacting each other.

Openings are formed through the horizontal base plate of the connector housing, and the crimp assisting walls of the press-connecting tool are passed respectively through these openings to face opposite sides of the press-connecting terminals, received in the terminal receiving chambers, to assist in deforming the crimp arms for clamping purposes. In this case, the crimp assisting walls are formed, for example, on an anvil or the like serving as a receiving member for the press-connecting tool. By doing so, a crimper for pressing down the crimp arms to deform the same for clamping purposes can be of a conventional construction.

That portion of the horizontal base plate of the connector housing corresponding to the press-connecting portions and the wire fixing portions of the press-connecting terminals can be retracted together with those portions of the partition walls disposed facing the outer sides of the crimp arms. With this construction, a load is prevented from acting on the horizontal base plate during the press-connecting operation, and during the press-connecting operation, the press-connecting terminal is supported, for example, by the anvil of the press-connecting tool. Therefore, the press-connecting operation can be carried out positively and properly, and the connector can be made more compact by reducing the thickness of the horizontal base plate of the connector housing.

DESCRIPTION OF THE PREFERRED EMBODIMENTS OF THE INVENTION

A preferred embodiment of a press-connecting connector of the present invention will now be described with reference to the drawings.

FIGS. 1 to 4 show a first preferred embodiment of a press-connecting connector according to the invention. FIG.

Figure 2:
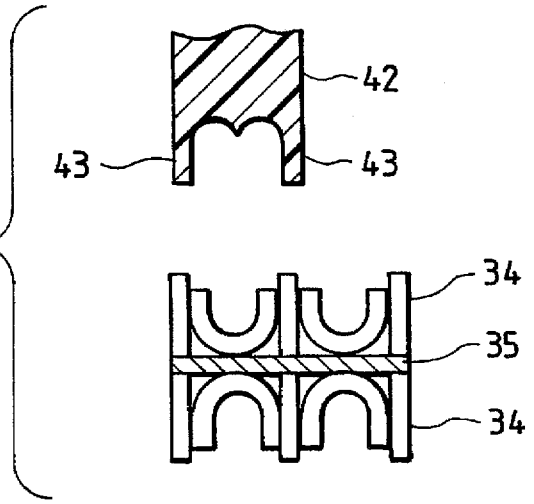
FIG. 2 is a cross-sectional view of an important portion of the press-connecting connector of FIG. 1 before a press-connecting operation.
Figure 3:
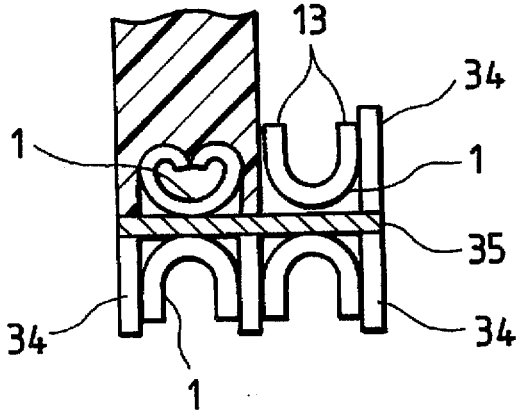
FIG. 3 is a cross-sectional view of an important portion of the press-connecting connector of FIG. 1 during the press-connecting operation.
Figure 4:
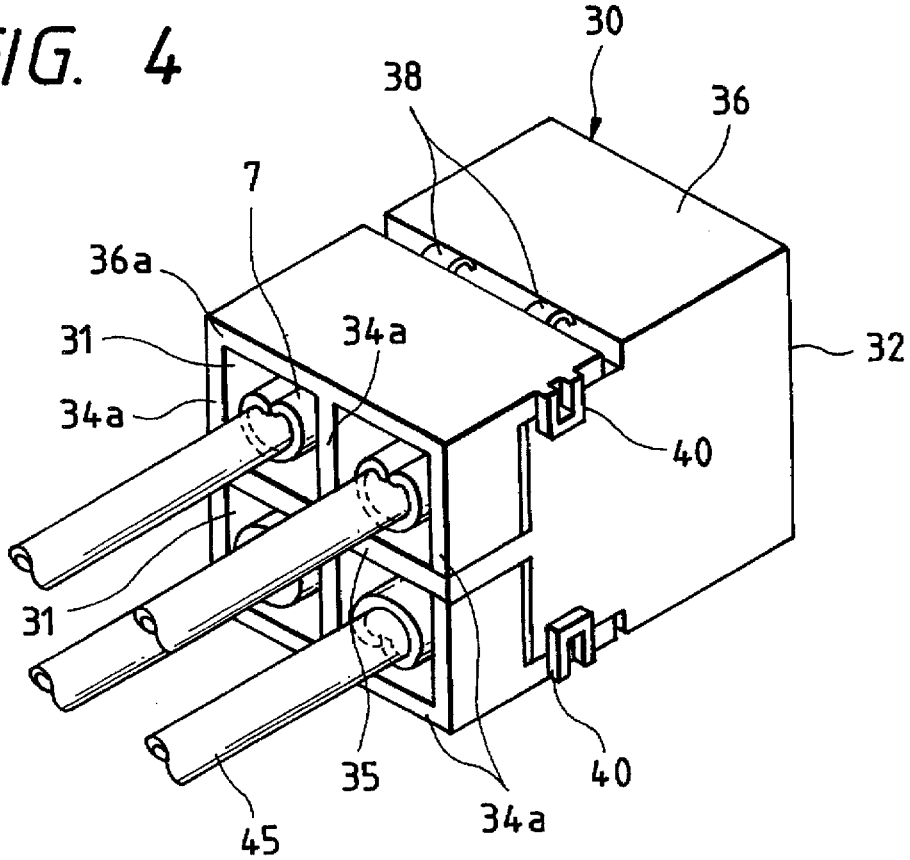
FIG. 4 is a perspective view of the press-connecting connector of FIG. 1.

1 is an exploded, perspective view of the press-connecting connector 30, FIGS. 2 and 3 are cross-sectional views of an important portion showing an operation of crimp arms in a wire press-connecting operation, and FIG. 4 is a perspective view showing the appearance of the connector after the press-connecting operation.

The press-connecting connector 30 includes press-connecting terminals 1, and a connector housing 32 of a synthetic resin having terminal receiving chambers 31 for respectively receiving the press-connecting terminals 1 in a neatly-arranged manner, the terminal receiving chambers 31 being arranged in two columns and two rows.

Figure 13:
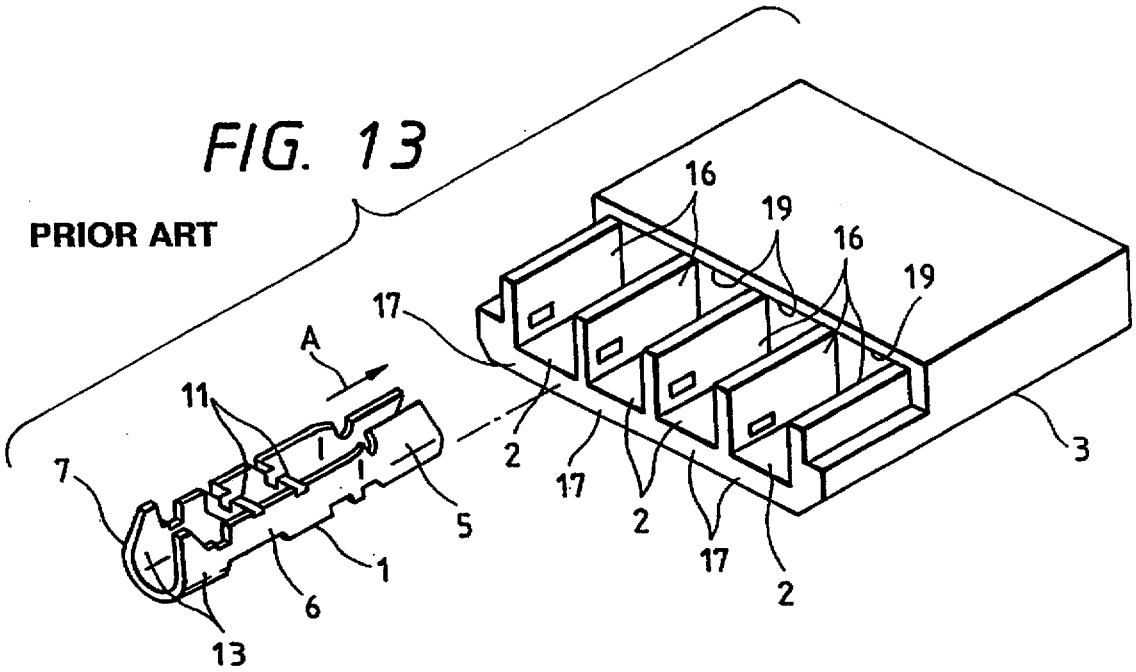
FIG. 13 PRIOR ART
FIG. 13 is an exploded, perspective view of a conventional press-connecting connector.
Figure 14:
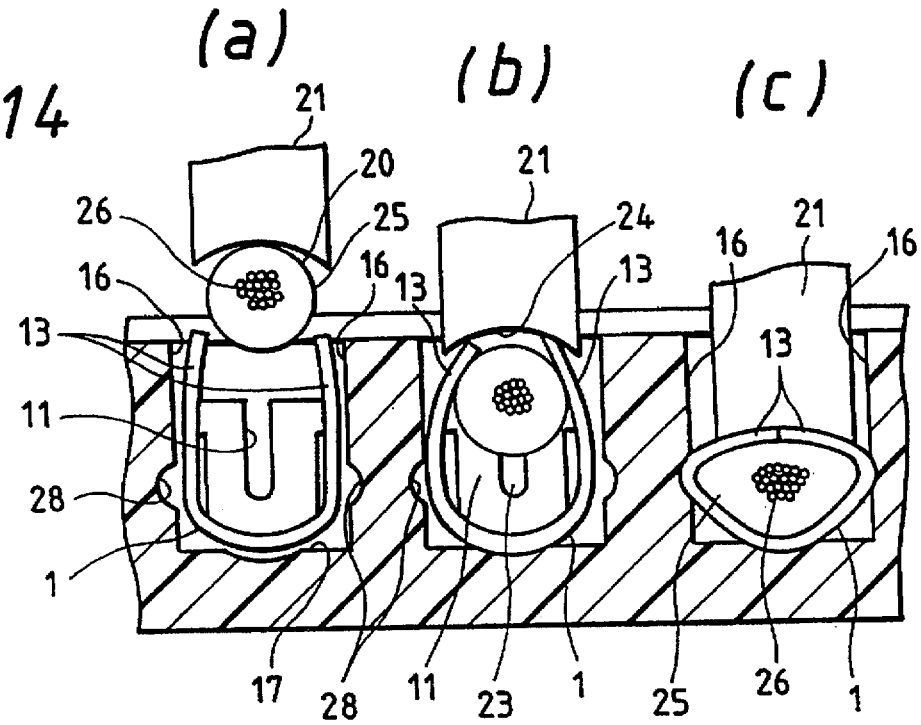
FIG. 14 PRIOR ART
FIG. 14 is a view explanatory of a wire press-connecting operation in the conventional press-connecting connector of FIG. 13.
Figure 15:
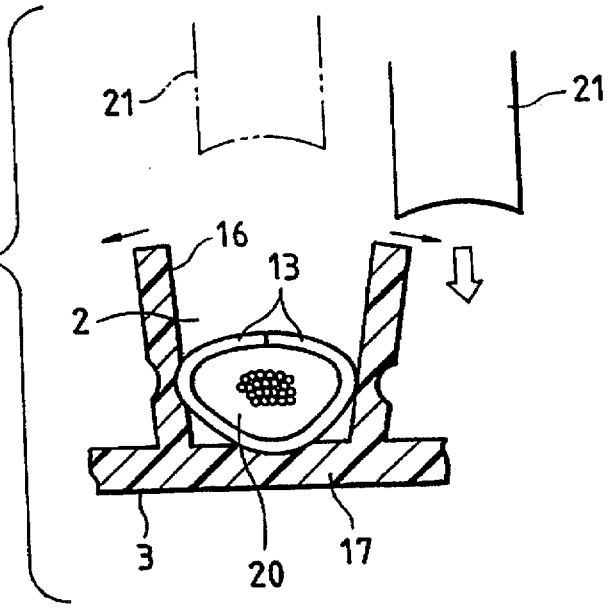
FIG. 15 PRIOR ART
FIG. 15 is a view explanatory of a problem with the conventional press-connecting connector of FIG. 13.

The press-connecting terminal 1 has the same construction as the conventional terminal shown in FIG. 13, and includes an electrical connection portion (not shown) formed at its front portion for fitting on a mating terminal, a press-connecting portion 6 formed at its central portion, and a wire fixing portion 7 formed at its rear end portion. This press-connecting terminal integrally constructed by blanking an electrically-conductive, thin metal sheet. The press-connecting portion 6 has press-connecting blades 11 which cut an insulating sheath of a sheathed wire when the sheathed wire is press-fitted into these blades 11, thereby making an electrical connection between the blades 11 and a conductor of the sheathed wire. The wire fixing portion 7 includes the pair of crimp arms 13 which are deformed by a press-connecting tool to fixedly hold the sheathed wire press-connected to the press-connecting blades 11.

The connector housing 32 includes a horizontal base plate 35, and terminal receiving chambers 31 provided respectively on upper and lower surfaces of the horizontal base plate 35 symmetrically with respect to this base plate 35. Each of the terminal receiving chambers 31 is formed by opposed partition walls 34 provided upright on the horizontal base plate 35 to cover opposite sides of the associated press-connecting terminal 1, the horizontal base plate 35, and an upper outer wall 36 provided on edges of the partition walls 34 to cover the upper side of the associated press-connecting terminal 1. With this construction, the adjacent press-connecting terminals 1 are prevented from contacting each other.

That portion (hereafter referred to as "upper wall rear portion") **36*a* of the upper outer wall 36 corresponding to the press-connecting portions 6 and wire fixing portions 7 of the press-connecting terminals 1 are integrally connected to those portions (hereinafter referred to as "side wall rear portions") 34*a* of the partition walls 34 facing the sides of the crimp arms 13 of the press-connecting terminals 1, so that the upper wall rear portion 36*a* and the side wall rear portions 34*a* cooperate with each other to provide a lid-like structure which is pivotally connected by hinges 38 to an upper wall front portion of the upper outer wall 36**.

The upper wall rear portion **36*a* and the side wall rear portions 34*a* can be retracted or pivotally moved from a position near the press-connecting terminals 1 to a position such that the front portion of the upper outer wall 36** is open.

In this retracted position, a crimper 42 of the press-connecting tool can descend from its upper stand-by position into the terminal receiving chamber 31 to press-fit the wire into the press-connecting portion 6 and also deform the crimp arms 13 for clamping purposes. In this embodiment, only that portion of the crimper 42 adapted to act on the crimp arms 13 is shown in the drawings.

The crimper 42 has a pair of crimp assisting walls 43 which, instead of the retracted side wall rear portions **34*a*, are brought into facing relation to the outer side surfaces of the crimp arms 13, respectively, when the crimper 42 moves downward into the terminal receiving chamber 31, so that the crimp assisting walls 43 can assist in deforming the crimp arms 31** for clamping purposes.

A pair of engagement piece portions 40 are formed respectively on the upper wall rear portion **36*a*, and are engaged respectively with a pair of retaining projections 39, formed respectively on the outer surfaces of the opposite outer (right and left) partition walls 34, when the upper wall rear portion 36*a* is pivotally moved or returned to its normal position where the upper wall rear portion 36*a* overlies the press-connecting portions 6 and the wire fixing portions 7, so that the upper wall rear portion. 36*a*** is held in its normal position.

Figure 1:
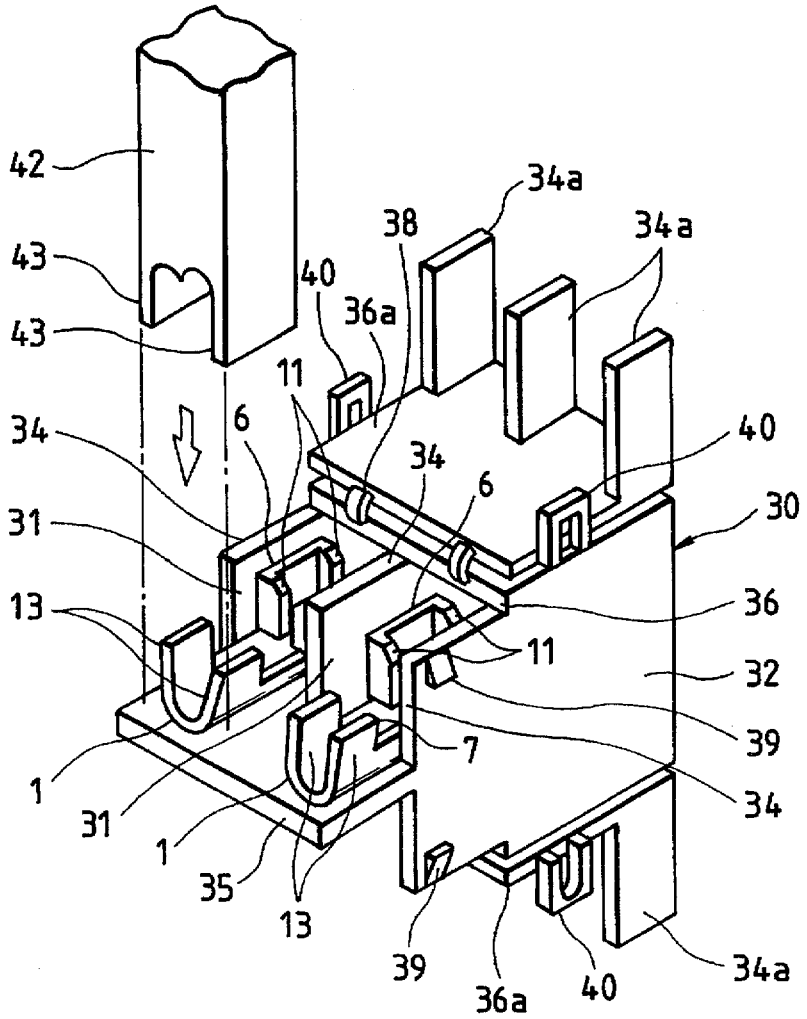
FIG. 1 is an exploded, perspective view of one preferred embodiment of a press-connecting connector of the present invention.

In the press-connecting connector 30 of the above construction, the side wall rear portions **34*a* and the upper wall rear portion 36*a* are retracted upwardly as shown in FIG. 1, and in this condition the press-connecting terminals 1 are inserted respectively into the terminal receiving chambers 31 from the rear side of the connector housing 32. After the insertion of the press-connecting terminals 1 is completed, the crimper 42 is moved downward as shown in FIG. 2, and subsequently the deformation of the crimp arms 13 for clamping purposes is effected (see FIG. 3) simultaneously with the press-fitting of the sheathed wire (not shown) into the press-connecting blades 11**.

At this time, instead of the partition walls 34, the crimp assisting walls 43 of the crimper 42 are brought into facing relation to the opposite sides of the wire fixing portion 7, respectively, and the pair of crimp arms 13 are pressed and deformed into a curved configuration while the crimp assisting walls 43 limit the displacement of the crimp arms 13. Thus, adverse effects on the partition walls 34 are eliminated.

This press-connection operation is effected for each of the press-connecting terminals 1 received in the respective terminal receiving chambers 31, and then the side wall rear portions **34*a* and the upper wall rear portion 36*a* are returned into the initial position, so that the adjacent press-connecting terminals 1 each having the sheathed wire 45 press-connected thereto are isolated from each other by the side wall rear portion 34*a* returned to its normal position, thereby preventing their wire fixing portions 7 from contacting each other, as shown in FIG. 4**.

As described above, in the press-connecting connector 30 of this embodiment, when the sheathed wire 45 is to be press-connected, the side wall rear portions **34*a* of the partition walls 34 (of the connector housing 32 which cover the sides of the press-connecting terminals 1 received in the respective terminal receiving chambers 31) facing the sides of the crimp arms 13 of the press-connecting terminals 1 are retracted from the position adjacent to the crimp arms 13 to the position above the upper outer wall 36, so that the crimp arms 13 of the press-connecting terminal 1, deformed during the press-fitting operation, will not interfere with the side wall rear portions 34*a*. Therefore, even when the partition walls 34 and the side wall rear portions 34*a* are reduced in thickness as a result of a compact connector design, these walls 34 and portions 34*a*** are prevented from undesirable deformation.

In the deformation of the crimp arms 13 of the press-connecting terminal 1 for clamping purposes, the crimp assisting walls 43, formed on the crimper 42 of the press-connecting tool, are brought into facing relation to the outer sides of the crimp arms 13. With this arrangement, the crimp arms can be properly deformed for clamping purposes, and therefore the crimp arms 13 are not inadequately deformed, and the strength of the wire connection is not decreased.

Therefore, the wire fan be press-connected to the press-connecting terminal 1 smoothly and positively even if the partition walls and the horizontal base plate of the connector housing 32 are reduced in thickness as a result of a compact connector design.

Figure 5:
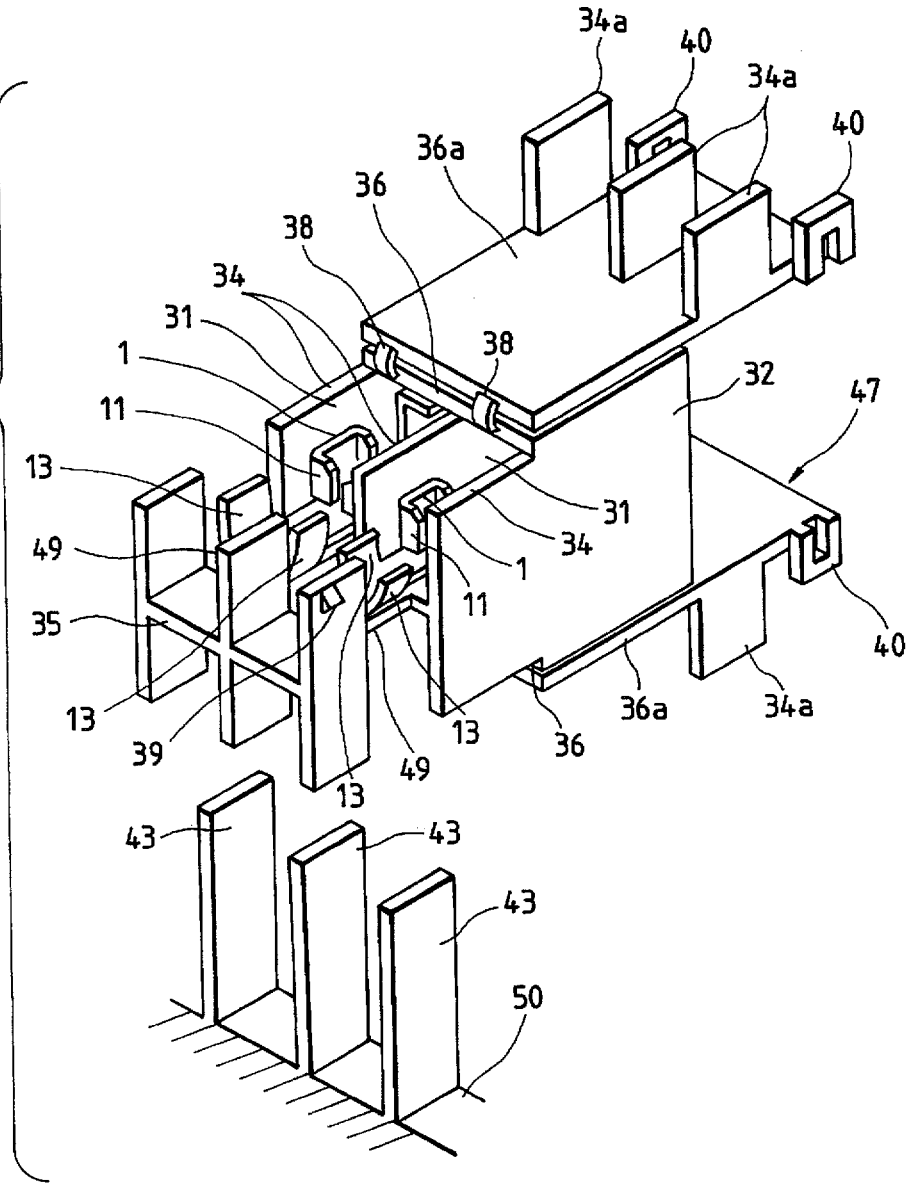
FIG. 5 is an exploded, perspective view of another preferred embodiment of a press-connecting connector of the invention.

FIG. 5 shows a second preferred embodiment of a press-connecting connector according to the present invention.

In the press,connecting connector 47 of this embodiment, crimp assisting walls 43 of a press-connecting tool, which are brought respectively into facing relation to the outer sides of the crimp arms 13 during the press-connection of the sheathed wire 45 so as to assist in deforming the crimp arms for clamping purposes, are changed.

More specifically, in the press-connecting connector 47, those portions of partition walls 34, corresponding to the wire fixing portions 7 of the press-connecting terminals 1 received in the respective terminal chambers 31, are removed, and openings 49 are formed respectively through those portions of a horizontal base plate 35 corresponding respectively to the above removed portions of the partition walls 34. The crimp assisting walls 43, which are brought respectively into facing relation to the outer sides of the crimp arms 13 of the press-connecting terminals 1 during the deformation of the crimp arms 13 for clamping purposes, are passed respectively through the openings 49 from the lower side of a connector housing 32. The crimp assisting walls 43 are disposed upright on an anvil 50 which serves as a receiving member for the press-connecting tool, and is inserted into the terminal receiving chambers 31 from the lower side of the housing in opposed relation to crimpers (not shown).

In the press-connecting connector 47 of this embodiment, those portions identical to those of the preceding embodiment are designated by identical reference numerals, respectively, and explanation thereof will be omitted here.

Figure 6:
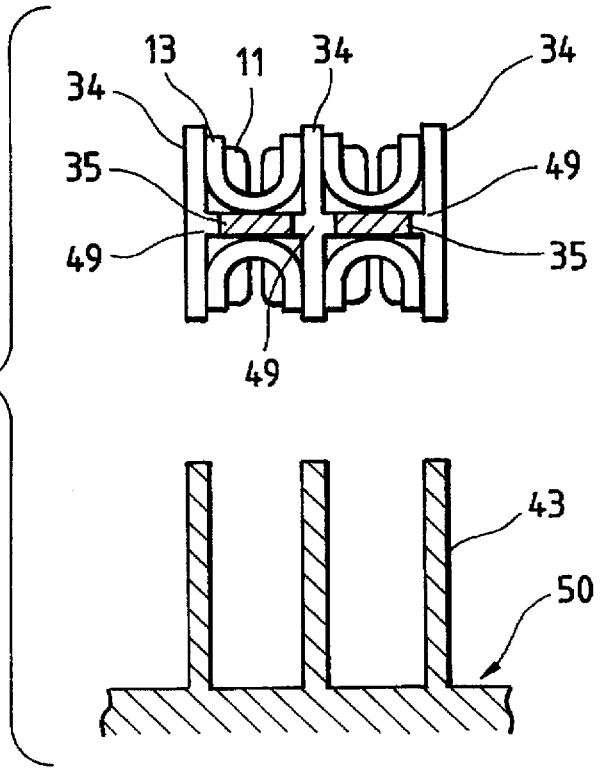
FIG. 6 is a cross-sectional view of an important portion of the press-connecting connector of FIG. 5 before a press-connecting operation.
Figure 7:
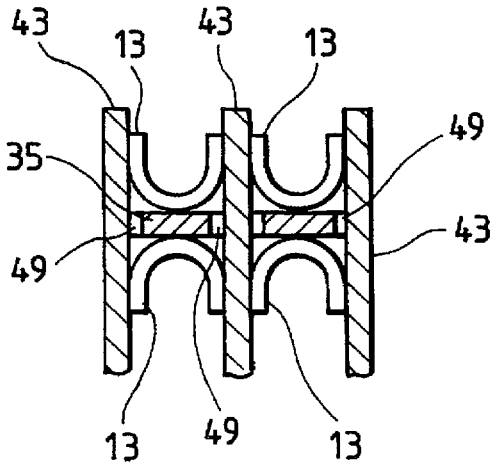
FIG. 7 is a cross-sectional view of an important portion of the press-connecting connector of FIG. 5 before the press-connecting operation.
Figure 8:
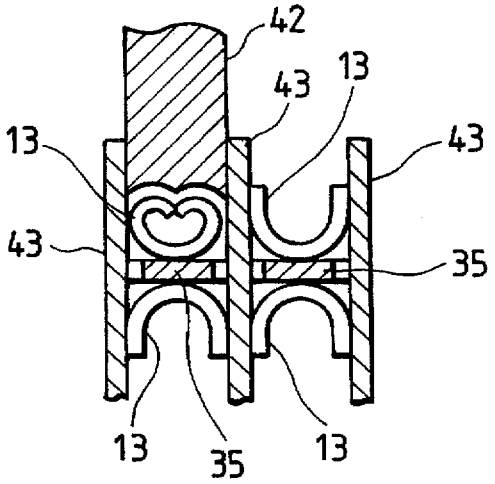
FIG. 8 is a cross-sectional view of an important portion of the press-connecting connector of FIG. 5 during the press-connecting operation.

This embodiment will now be more specifically described. In the press-connecting connector 47, side wall rear portions **34*a* and upper wall rear portions 36*a* are retracted in overlying relation to an upper outer wall 36, and in this condition the press-connecting terminals 1 are inserted into the terminal receiving chambers 31, respectively, as shown in FIG. 5. After all of the press-connecting terminals 1 are completely inserted into the respective terminal receiving chambers 31 as shown in FIG. 6, the anvil 50 is moved upward from its stand-by position below the connector housing 32, so that the crimp assisting walls 43, formed upright on the anvil 50, are passed respectively through the openings 49 in the horizontal base plate 35, and are brought respectively into facing relation to the opposite sides of the wire fixing portions 7 of the press-connecting terminals 1 as shown in FIG. 7. In this condition, the crimper 42 is moved downward from its upper stand-by position into the space between the adjacent crimp assisting walls 43, thereby deforming the crimp arms 13 for clamping purposes, as shown in FIG. 8**.

In the press-connecting connector 47 of this construction, similar effects as described in the preceding embodiment are achieved. The crimp assisting walls 43 are formed on the anvil serving as the receiving member for the press-connecting tool, and therefore the crimper 42 of the press-connecting tool, pressed down for deforming the crimp arms 13, can be of conventional construction, and the improvement of the press-connecting tool can be kept to a minimum.

Figure 9:
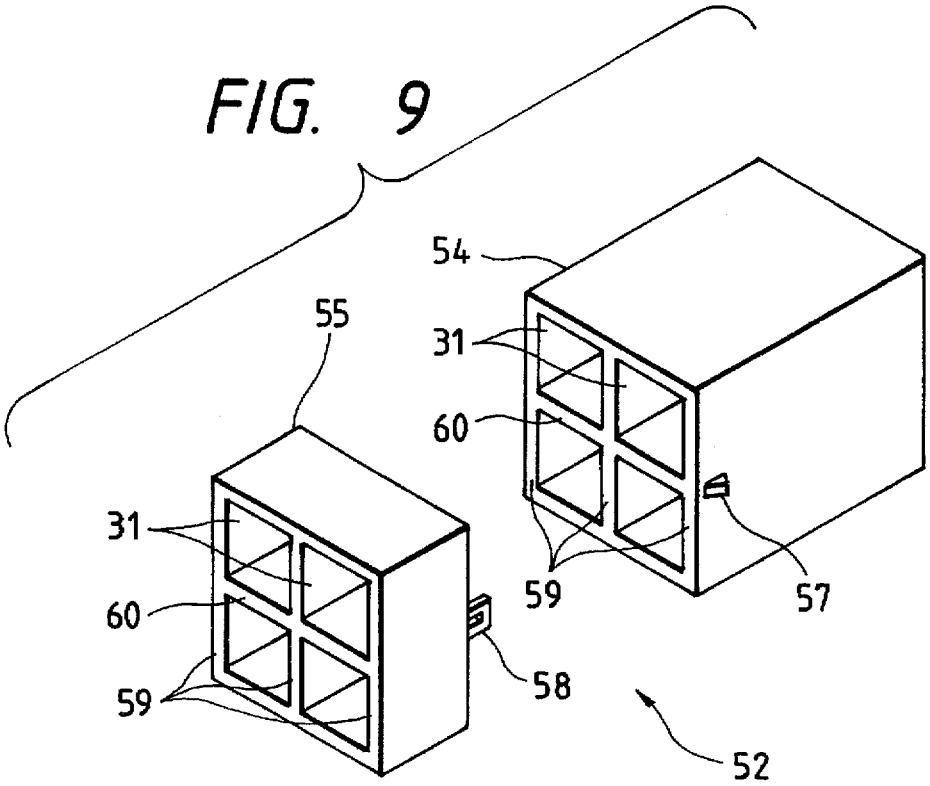
FIG. 9 is an exploded, perspective view of a housing of another preferred embodiment of a press-connecting connector according to the invention.

FIG. 9 shows a third preferred embodiment of a press-connecting connector according to the invention.

A connector housing of this press-connecting connector 52 having terminal receiving chambers 31 comprises a front housing 54 and a rear housing 55 which can be separated from each other.

Retaining projections 57 are formed on an outer surface of the front housing 54, and engagement piece portions 58, corresponding respectively to the retaining projections 57, are formed on an outer surface of the rear housing 55. By the engagement of the engagement piece portions 58 with the respective retaining projections 57, front and rear housings 54 and 55 are fixedly connected together to function as the single connector housing.

The front housing 54 houses the electrical connection portions of the press-connecting terminals 1 (not shown in FIG. 9), and the rear housing 55 houses the press-connecting portions 6 and wire fixing portions 7 of the press-connecting terminals 1. The front and rear housings 54 and 55 have terminal receiving chambers 31 formed by partition walls 59 and horizontal base plates 60, the partition walls 59 covering the opposite sides of the press-connecting terminals 1 received in the respective terminal receiving chambers while the horizontal base plates 60 support the bottoms of the press-connecting terminals 1.

The partition walls 59 and the horizontal base plate 60 of the rear housing 55 cover the press-connecting portions 6 and wire fixing portions 7 of the press-connecting terminals 1 as in the above embodiments. Therefore, when the rear housing 55 is separated from the front housing 54 as shown in FIG. 10, the press-connecting portions 6 and wire fixing portions 7 of the press-connecting terminals 1 received in the respective terminal receiving chambers 31 in the front housing 54 are exposed to the exterior as shown in FIG. 10.

In order words, when the rear housing 55 is separated from the front housing 54, the partition walls 59 and horizontal base plate 60 of the rear housing 55 are retracted from the position where they cover the press-connecting portions 6 and wire fixing portions 7 of the press-connecting terminals 1.

Figure 10:
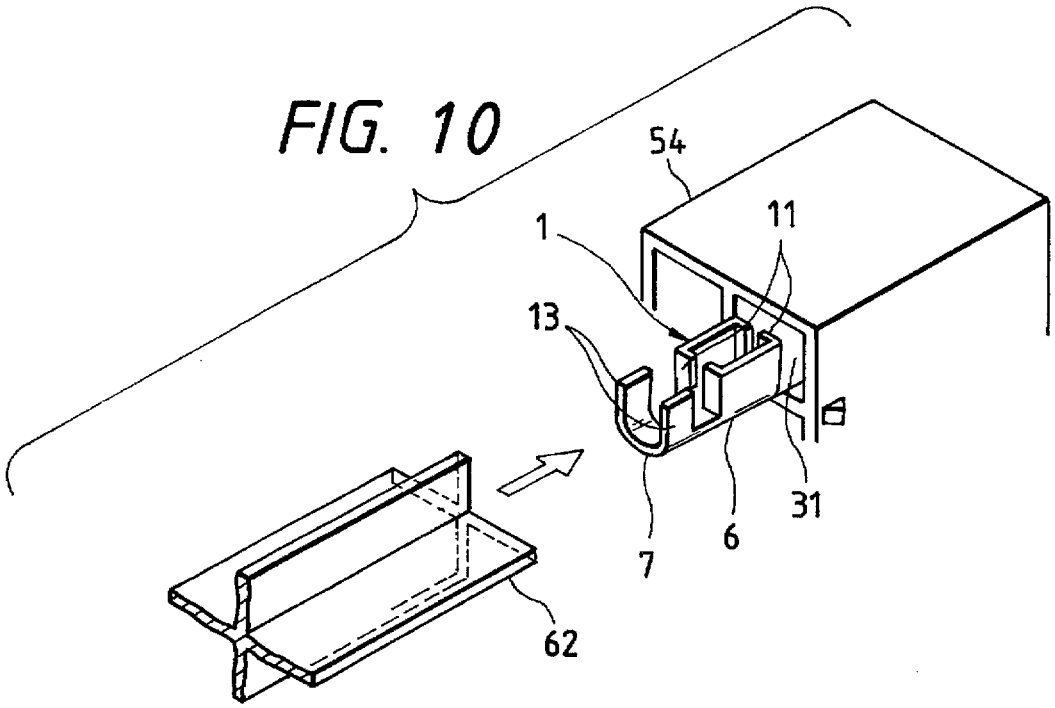
FIG. 10 is a perspective view showing a condition in which a terminal is attached to the press-connecting connector of FIG. 9.
Figure 11:
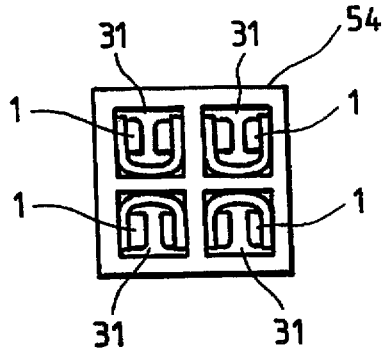
FIG. 11 is a perspective view showing a condition in which the attachment of the terminals to the press-connecting connector of FIG. 9 is completed.
Figure 12:
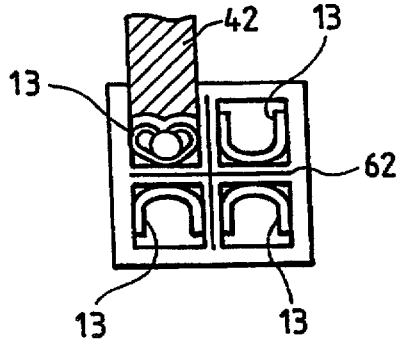
FIG. 12 is a cross-sectional view of the press-connecting connector of FIG. 9 during a press-connecting operation.

Therefore, in this press-connecting connector 52, the rear housing 55 is separated from the front housing as shown in FIGS. 10 and 11, and then the press-connecting terminals 1 are inserted respectively into the terminal receiving chambers 31 in the front housing 54, and then an anvil 62 of a press-connecting tool having a cross-shaped transverse cross-section is inserted from the rear side of the connector housing 52 into spaces between the press-connecting terminals 1 to isolate these terminals 1 from one another. The anvil 62 is held in this position, and a crimper 42 is moved downward relative to the press-connecting terminal 1, thereby effecting the press-fitting of the wire and the deformation of the crimp arms 13.

The crimp arms 13 of all of the terminals are thus deformed for clamping purposes, and the crimper and the anvil 62 are retracted from their operative positions, and then the rear housing 55 is connected to the front housing 54.

FIG. 11 shows a condition (as viewed in the direction of insertion of the press-connecting terminals 1, that is, from the rear side of the housing) in which the press-connecting terminals 1 are received respectively in all of the terminal receiving chambers 31.

In this press-connecting connector 52, similar effects as described in the above embodiments are achieved. The partition walls 59 and the horizontal base plate 60 of the rear housing, corresponding to the press-connecting portions 6 and wire fixing portions 7 of the press-connecting terminals 1, can be retracted in unison, and therefore a load is prevented from acting on the horizontal base portion 60 during the press-fitting operation, and the bottoms of the press-connecting terminals 1 are supported by the anvil 62 of the press-connecting tool during the press-fitting operation, and therefore the press-connecting operation can be effected positively and properly, and compact design of the connector can be achieved by reducing the thickness of the horizontal base plate 60.

In the connector housings of the above embodiments, although the terminal receiving chambers are arranged in two rows and two columns, the arrangement of the connector housing is not limited to those shown in the above embodiments. For example, the terminal receiving chambers can be arranged in one row and three or more columns, or in two rows and three or more columns.

In the press-connecting connector of the invention, when the sheathed wires are to be press-fitted into the respective press-connecting terminals mounted respectively in the terminal receiving chambers in the connector housing, those portions of the partition walls (which cover the sides of the press-connecting terminals in the terminal receiving chambers) of the terminal receiving chambers disposed facing the outer sides of the crimp arms are retracted from the position where those portions face the outer sides of the crimp arms. By doing so, the crimp arms of the press-connecting terminal can be deformed for clamping purposes during the press-fitting operation without interfering with the partition walls of the connector housings. Therefore, even if the partition walls are reduced in thickness as a result of compact design of the connector, the partition walls will not be subjected to undesirable deformation due to abutment of the crimp arms against the partition walls.

The press-connecting tool for deforming the crimp arms of the press-connecting terminals during the press-connecting operation has crimp assisting walls which are brought into facing relation to the outer sides of the crimp arms to assist in deforming the crimp arms. By doing so, the crimp arms can be properly deformed for clamping purposes, and the disadvantage of inadequate deformation of the crimp arms resulting in decreased strength of the wire connection is eliminated.

Openings can be formed through the horizontal base plate of the connector housing, and the crimp assisting walls of the press-connecting tool can then be passed respectively through these openings to respectively face the opposite sides of the press-connecting terminals, received respectively in the terminal receiving chambers, to assist in deforming the crimp arms for clamping purposes. In this case, the crimp assisting walls are disposed, for example, on an anvil or the like serving as the receiving member for the press-connecting tool. By doing so, the crimper for pressing down the crimp arms to deform the same for clamping purposes can be of a conventional construction, and therefore the improvement of the press-connecting jig can be kept to a minimum.

That portion of the horizontal base plate of the connector housing corresponding to the press-connecting portions and the wire fixing portions of the press-connecting terminals can be made retractable together with those portions of the partition walls disposed respectively in facing relation to the outer sides of the crimp arms. With this construction, a load is prevented from acting on the horizontal base plate during the press-connecting operation, and during the press-connecting operation, the press-connecting terminal is supported, for example, by an anvil of the press-connecting tool. Therefore, the press-connecting operation can be carried out positively and properly, and the connector can be made more compact by reducing the thickness of the horizontal base plate of the connector housing.

What is claimed is:

1. A connector, comprising:

a first housing having a terminal receiving chamber provided therein for receiving a terminal including an electrical contact portion and a wire connecting portion for connecting a wire, said terminal receiving chamber being defined by first partition walls on opposite side thereof, a flat base plate and a first outer wall, wherein said wire connecting portion of said terminal is exposed from said terminal receiving chamber; and a covering member for covering said wire connecting portion, said covering member being either integrally or separately formed on said first housing, and wherein said wire connecting portion is deformed so as to clamp to said wire by a tool including crimp assisting walls for assisting in deforming said wire connecting portion, when said wire connecting portion is not covered by said covering member.

2. The connector of claim 1, wherein said covering member includes second partition walls and a second outer wall.

3. The connector of claim 2, wherein said covering member has a hinge portion, said second outer wall of said covering member is pivotally connected to said first outer wall through said hinge portion.

4. The connector of claim 1, wherein said covering member includes a second housing having a terminal accommodating chamber corresponding to said terminal receiving chamber.

5. The connector of claim 1, wherein said first housing has a retaining member, said covering member has a retained member, said covering member is fitted on said first housing by retaining said retaining member with said retained member.

6. The connector of claim 1, wherein said base plate includes an end portion thereof which extends beneath said wire connecting portion to provide a resistance to said tool when said tool deforms said wire connecting portion.

7. The connector of claim 1, wherein said covering member is movable from a first position where it covers said wire connecting portion to a second position where it does not cover said wire connecting portion.

8. A connector, comprising:

a first housing having a terminal receiving chamber provided therein for receiving a terminal having an electrical contact portion and a wire connecting portion for connecting a wire, said terminal receiving chamber being defined by first partition walls on opposite sides thereof, a flat base plate and a first outer wall, wherein said wire connecting portion of said terminal is exposed from said terminal receiving chamber; and a covering member for covering said wire connecting portion, said covering member being either integrally or separately formed on said first housing, wherein said wire connecting portion is deformed to clamp to said wire by a crimping tool, in cooperation with an anvil having crimp assisting walls, when said wire connecting portion is not covered by said covering member.

9. The connector of claim 8, wherein said covering member is movable from a first position where it covers said wire connecting portion to a second position where it does not cover said wire connecting portion.

10. The connector of claim 9, wherein said covering member comprises second partition walls and a second outer wall.

11. The connector of claim 10, wherein said covering member further comprises a hinge portion, and said second outer wall of said covering member is pivotably connected to said first outer wall through said hinge portion.

12. The connector of claim 9, wherein said covering member comprises a second housing having a terminal accommodating chamber corresponding to said terminal receiving chamber.

13. The connector of claim 9, wherein said first housing has a retaining member, said covering member has a retained member, and said covering member is fitted on said first housing by retaining said retaining member with said retained member.

14. The connector of claim 9, wherein said flat base plate includes an end portion thereof which extends beneath said wire connecting portion and has openings disposed adjacent to said wire connecting portion for accommodating said crimp assisting walls of said anvil.

* * * * *